US009512595B2

(12) United States Patent
Ono

(10) Patent No.: US 9,512,595 B2
(45) Date of Patent: Dec. 6, 2016

(54) ELECTRIC SWIVELING TYPE CONSTRUCTION MACHINE

(71) Applicant: Sumitomo Heavy Industries, Ltd., Tokyo (JP)

(72) Inventor: Tetsuji Ono, Chiba (JP)

(73) Assignee: Sumitomo Heavy Industries, Ltd., Tokyo (JP)

( * ) Notice: Subject to any disclaimer, the term of this patent is extended or adjusted under 35 U.S.C. 154(b) by 0 days.

(21) Appl. No.: 14/644,835

(22) Filed: Mar. 11, 2015

(65) Prior Publication Data

US 2015/0259879 A1 Sep. 17, 2015

(30) Foreign Application Priority Data

Mar. 12, 2014 (JP) ..... 2014-049500

(51) Int. Cl.
*E02F 9/20* (2006.01)
*E02F 9/12* (2006.01)

(52) U.S. Cl.
CPC ..... *E02F 9/128* (2013.01); *E02F 9/2075* (2013.01)

(58) Field of Classification Search
CPC ..... E02F 9/128; E02F 9/2075
See application file for complete search history.

(56) References Cited

U.S. PATENT DOCUMENTS 5,823,369 A * 10/1998 Kuromoto ..... B25J 9/1638 212/223
8,405,328 B2 3/2013 Komiyama et al.
2011/0057596 A1* 3/2011 Kagoshima ..... B60L 3/0061 318/490

FOREIGN PATENT DOCUMENTS

JP EP 1731680 A1 * 12/2006 ..... E02F 9/121
JP 2011-190664 A 9/2011

* cited by examiner

*Primary Examiner* — Mary Cheung
(74) *Attorney, Agent, or Firm* — Michael Best & Friedrich LLP

(57) ABSTRACT

An electric swiveling type construction machine includes a lower travelling body, an upper swivel body which is turnably mounted on the lower travelling body, a boom in which one end is rotatably attached to the upper swivel body, an arm in which one end is rotatably attached to the other end of the boom, a working element which is rotatably attached to the other end of the arm, a brake mechanism which holds the upper swivel body, a swiveling motor which swivels and drives the upper swivel body, a state monitoring unit which monitors the state of the brake mechanism, and a controller which detects releasing of braking performed by the brake mechanism based on the monitor by the state monitoring unit. The swiveling motor does not generate a force until the controller detects the releasing of the brake.

2 Claims, 7 Drawing Sheets

ELECTRIC SWIVELING TYPE CONSTRUCTION MACHINE

RELATED APPLICATIONS

Priority is claimed to Japanese Patent Application No. 2014-049500, filed Mar. 12, 2014, the entire content of which is incorporated herein by reference.

BACKGROUND

Technical Field

The present disclosure relates to a construction machine which includes an electric swiveling type swivel driving device.

Description of Related Art

In a construction machine such as a shovel, in order to swivel a working element and move the working element to a working position, in most cases, a swivel driving device for swiveling and driving a swivel body to which the working element is attached is provided.

In the swivel driving device, a brake device (mechanical brake) which mechanically stops the swivel body is provided. When a swiveling motor is not driven, braking performed by the mechanical brake occurs so as to stop the swivel body. Moreover, when the swivel body is driven, the braking performed by the mechanical brake is released. In general, in the related art, operating and releasing of the braking performed by the mechanical brake are switched using hydraulic pressure.

SUMMARY

According to an embodiment of the present invention, there is provided an electric swiveling type construction machine, including: a lower travelling body; an upper swivel body which is turnably mounted on the lower travelling body; a boom in which one end is rotatably attached to the upper swivel body; an arm in which one end is rotatably attached to the other end of the boom; a working element which is rotatably attached to the other end of the arm; a brake mechanism which holds the upper swivel body; a swiveling motor which swivels and drives the upper swivel body; a state monitoring unit which monitors a state of the brake mechanism; and a controller which detects releasing of braking performed by the brake mechanism based on the monitoring performed by the state monitoring unit, in which the swiveling motor does not generate a force until the controller detects the releasing of the brake.

DETAILED DESCRIPTION

Figure 1:
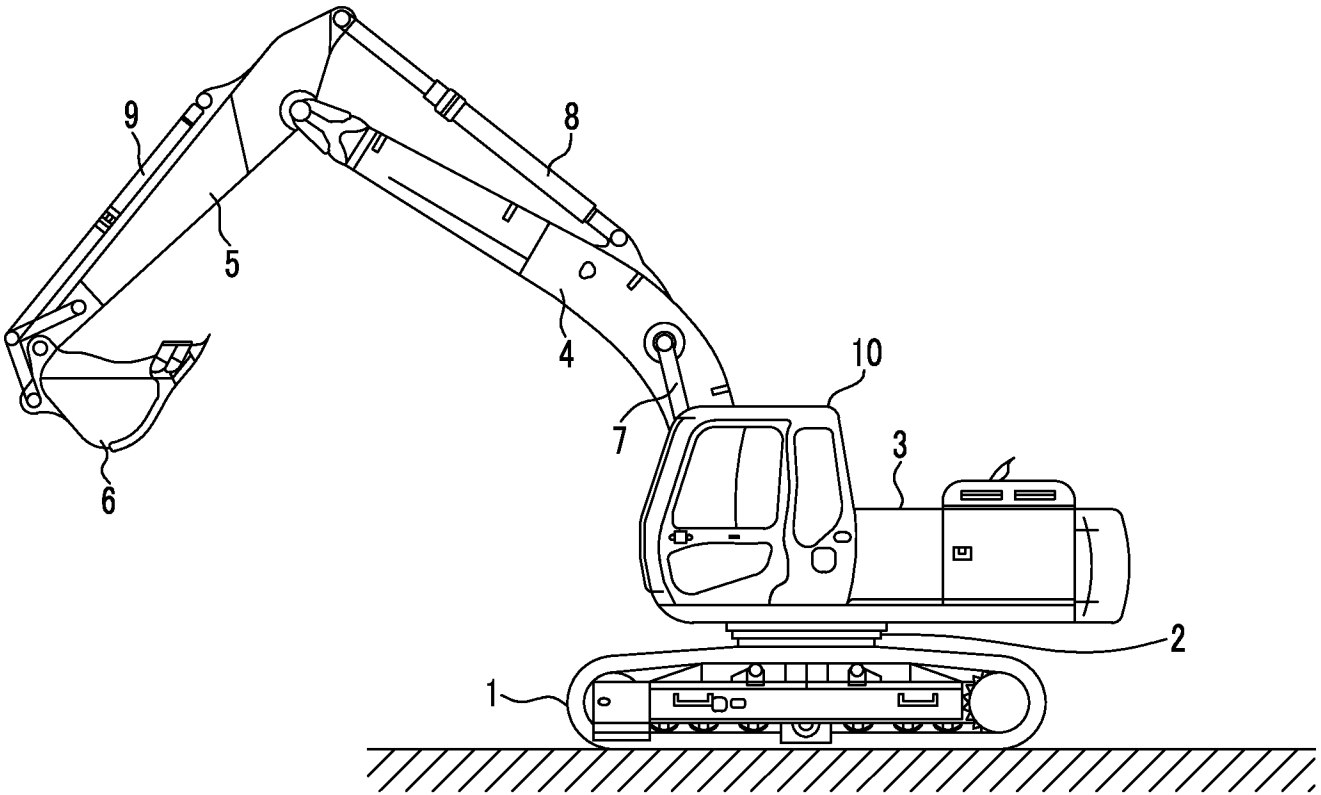
FIG. 1 is a side view of a shovel according to an embodiment.

In a swivel driving device which is mounted on a construction machine, when a swivel body is swiveled or stopped, it is very important to match the timing between the releasing of a brake and the controlling of a swiveling motor.

However, in the related art, in a control mechanism of a construction machine, according to the change in characteristics of hydraulic oil due to the working environment, the timing between the releasing of the brake and the driving control of the swiveling motor may be deviated.

When the deviation in the timing occurs, during braking performed by the mechanical brake, the driving control of the swiveling motor may be performed, and thus, there is a concern that components of the mechanical brake may be worn.

In addition, during the releasing of the braking performed by the mechanical brake, if the driving control of the swiveling motor is not performed, for example, in a case in which a shovel is stopped on a slope, there is a concern that the swivel body may inevitably rotate toward the downward direction of the slope due to the weight of the swivel body.

In consideration of the above-described circumstances, it is desirable to provide an electric swiveling type construction machine capable of eliminating the deviation in the timing between the releasing of the braking performed by the brake device and the driving control of the swiveling motor.

Hereinafter, an embodiment will be described in detail with reference to the accompanying drawings. Moreover, in each drawing, the same reference numerals are assigned to the same components, and overlapping descriptions thereof may be omitted.

First, the entire configuration of a shovel into which a swivel driving device according to an embodiment of the invention is incorporated and the configuration of a drive system thereof will be described. FIG. 1 is a side view showing a construction machine into which the swivel driving device according to the embodiment of the invention is incorporated. Moreover, in FIG. 1, the shovel is shown as an example of the construction machine. The swivel driving device according to the embodiment of the invention can be incorporated into the construction machine having a mechanism which rotates an upper swivel body thereof.

An upper swivel body 3 is turnably mounted on a lower travelling body 1 of the shovel shown in FIG. 1 via a swiveling mechanism 2. One end of a boom 4 is rotatably attached to the upper swivel body 3. One end of an arm 5 is rotatably attached to the tip (the other end) of the boom 4, and a bucket 6 (working element) is rotatably attached to the tip (the other end) of the arm 5 . The boom 4, the arm 5, and the bucket 6 are hydraulically driven by a boom cylinder 7, an arm cylinder 8, and a bucket cylinder 9. A cabin 10 is provided in the upper swivel body 3, and a drive source such as an engine is mounted in the upper swivel body 3.

In the shovel according to the present embodiment, an electric swivel type swivel driving device which uses an electric motor may be used. Hereinafter, a case in which the electric swivel driving device is mounted on the shovel will be described.

In addition, the shovel shown in FIG. 1 includes a power storage device which accumulates power supplied to the swivel driving device. However, certain embodiments of the invention may be applied to an arbitrary shovel which adopts the electric swivel, and for example, certain embodiments of the invention may be also applied to an electric drive type shovel in which power is supplied from an external power source.

Figure 2:
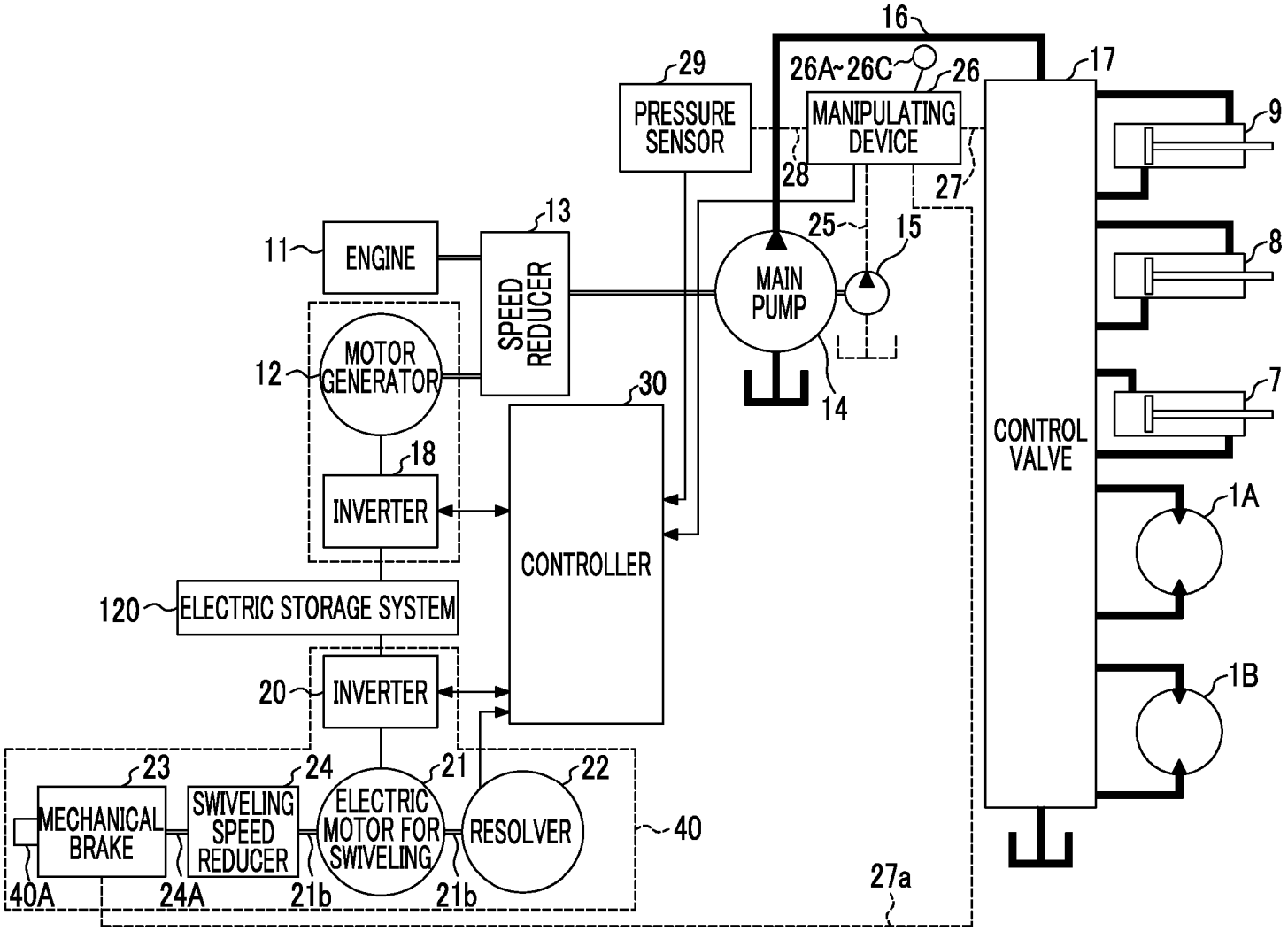
FIG. 2 is a block diagram showing a configuration of a drive system of the shovel according to the embodiment.

FIG. 2 is a block diagram showing the configuration of the drive system of the shovel shown in FIG. 1. In FIG. 2, a mechanical power system is indicated by a double line, a high-pressure hydraulic line is indicated by a thick solid line, a pilot line is indicated by a broken line, and an electric drive and control system is indicated by a thin solid line.

An engine 11 serving as a mechanical drive section and a motor generator 12 serving as an assist drive section are connected to two input shafts of a transmission 13. A main pump 14 and a pilot pump 15 serving as a hydraulic pump are connected to an output shaft of the transmission 13. A control valve 17 is connected to the main pump 14 via a high-pressure hydraulic line 16. In addition, an operating device 26 is connected to the pilot pump 15 via a pilot line 25.

The control valve 17 is a controller which controls a hydraulic system in a hybrid type shovel. A (right) hydraulic motor 1A and a (left) hydraulic motor 1B for the lower travelling body 1, the boom cylinder 7, the arm cylinder 8, and the bucket cylinder 9 are connected to the control valve 17 via the high-pressure hydraulic line.

A power storage system (power storage device) 120 including a capacitor serving as an electric storage device is connected to the motor generator 12 via an inverter 18. A swivel electric motor 21 (swiveling motor) is connected to the electric storage system 120 via the inverter 20. A resolver 22 and a swivel speed reducer 24 are connected to an output shaft 21*b* (motor shaft) of the swivel electric motor 21. A mechanical brake 23 is connected to an output shaft 24A of the swivel speed reducer 24. The swivel electric motor 21, the resolver 22, the mechanical brake 23, and the swivel speed reducer 24 configure a swivel driving device 40 serving as a load drive system. Here, the swivel electric motor 21 corresponds to a swivel electric motor which swivels and drives the upper swivel body 3, and the mechanical brake 23 corresponds to a brake device which mechanically stops the upper swivel body 3.

The operating device 26 includes a lever 26A, a lever 26B, and a pedal 26C. The lever 26A, the lever 26B, and the pedal 26C are respectively connected to the control valve 17 and the pressure sensor 29 via hydraulic lines 27 and 28. The pressure sensor 29 is connected to a controller 30 which performs the driving control of an electric system.

The controller 30 is a controller serving as a main control unit which performs the driving control of the hybrid type shovel. The controller 30 is configured of a calculation processing device which includes a CPU (Central Processing Unit) and an internal memory, and is a device which is operated by executing a program for the driving control stored in the internal memory through the CPU.

The controller 30 converts signals supplied from the pressure sensor 29 into a speed command, and performs the driving control of the swivel electric motor 21. The signals supplied from the pressure sensor 29 are equivalent to the signals which indicate the amount of manipulation when the operating device 26 is manipulated to swivel the swiveling mechanism 2.

The controller 30 performs an operation control (switching between electric driving (assist) operation and electric generation operation) of the motor generator 12, and performs the charging and discharging control of the capacitor by carrying out the driving control of a step up and down converter of the electric storage system 120. The controller 30 performs the switching control between the step-up operation and the step-down operation of the step up and down converter of the electric storage system 120 based on the charging state of the capacitor, the operation state (electric driving (assist) operation or electric generation operation) of the motor generator 12, and the operation state (power running operation or regenerative running operation) of the swivel electric motor 21, and thus, the charging and discharging control of the capacitor is performed. In addition, as described below, the controller 30 also controls the amount (charging current or charging power) of charge in the capacitor.

When work is performed using the shovel having the above-described configuration, in order to swivel and drive the upper swivel body 3, the swivel electric motor 21 is driven by the current supplied via the inverter 20. The rotating force of the output shaft 21*b* of the swivel electric motor 21 is transmitted to an output shaft 40A of the swivel driving device 40 via the swivel speed reducer 24 and the mechanical brake 23.

Figure 3:
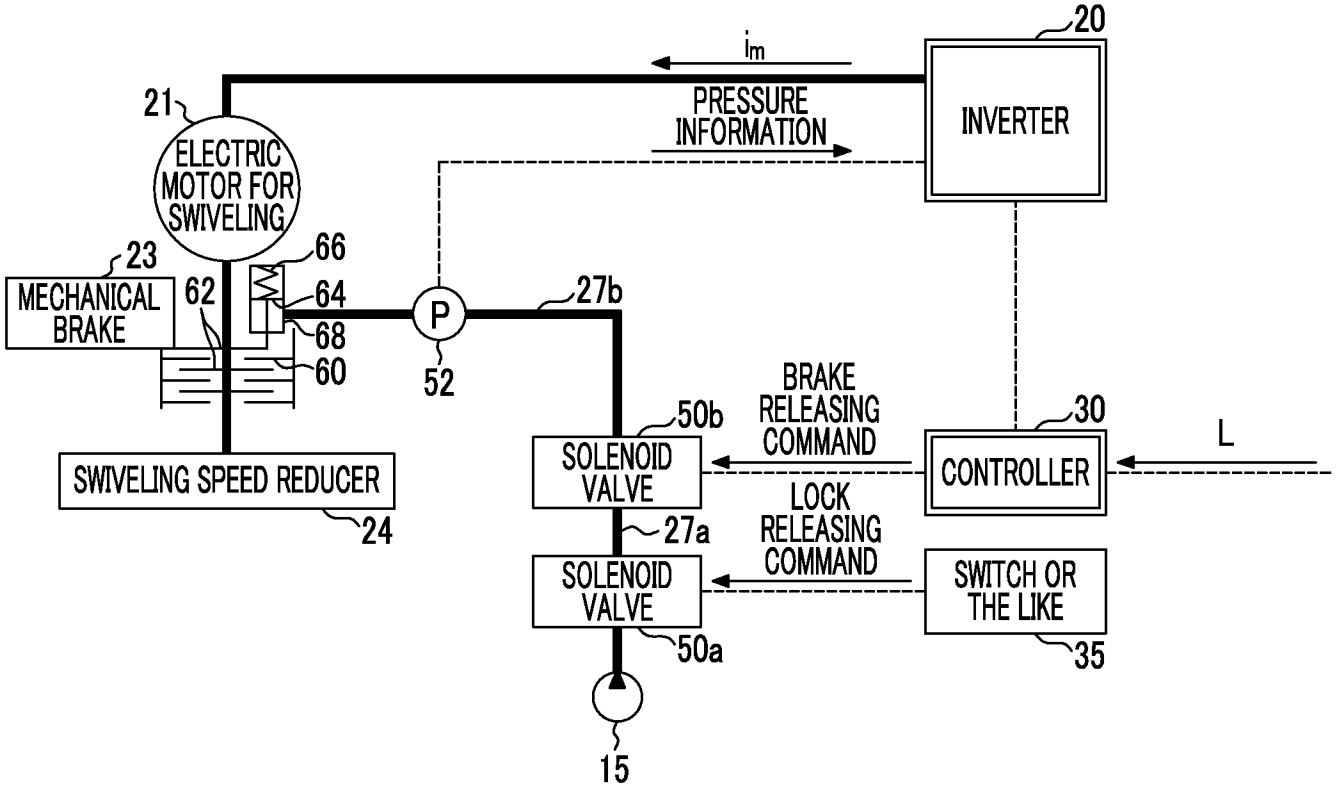
FIG. 3 is a block diagram showing a control mechanism of a swivel driving device provided in the shovel according to the embodiment.

Next, the control mechanism of the swivel driving device 40 will be described with reference to FIG. 3. FIG. 3 is a block diagram showing the control mechanism of the swivel driving device provided in the shovel according to the embodiment.

As shown in FIG. 3, the swivel speed reducer 24 is connected to the swivel electric motor 21 in a state where the mechanical brake 23 is interposed between the swivel speed reducer 24 and the swivel electric motor 21. The mechanical brake 23 is configured to include brake disks 60, brake plates 62, a piston 64, a spring 66, and a cylinder 68. The brake plate 62 is disposed on both the upper and lower sides of the brake disk 60. When the brake is operated, the piston 64 presses against the spring 66, and presses against the upper brake plate 62 at all times . When the upper brake plate 62 presses against the piston 64, the brake disk 60 is pressed such that the brake disk 60 is interposed between the upper and lower brake plates 62. Since the brake disk 60 is pressed such that the brake disk 60 is interposed between the upper and lower brake plates 62, a braking force which prevents the rotation of the brake disk 60 is applied to the brake disk 60. Moreover, when the hydraulic oil is supplied to the cylinder 68 via a hydraulic line 27*b* from the pilot pump 15, the piston 64 is pushed upward by the hydraulic pressure of the hydraulic oil, the force pressing against the brake plate 62 is reduced to zero, and the brake is released. The pilot pump 15 is connected to the cylinder 68 via solenoid valves 50*a* and 50*b* by the hydraulic lines 27*a* and 27*b*. In addition, a lock mechanism 35 which includes a gate lock switch (not shown), a gate lock lever (not shown), or the like is provided in the driver seat of the cabin 10.

The gate lock switch is a switch which detects whether or not the gate lock lever is manipulated to a lock releasing position, or whether or not the gate lock lever is manipulated to a locked position. An operator manipulates the gate lock lever to lower the gate lock lever to the lock releasing position and closes the entrance door to the operator cab of the cabin 10, and the operator manipulates the gate lock lever to lift the gate lock lever to the locked position and opens the entrance door to the operator cab. That is, when the operator gets in and out the shovel, the gate lock lever is manipulated from the lock releasing position to the locked position.

When the gate lock lever is manipulated to the lock releasing position by the operator, a lock releasing command is sent, the solenoid valve 50 is switched, and the hydraulic oil of the pilot pump 15 is supplied to the hydraulic line 27*a*. Subsequently, when the operator manipulates a swivel lever, a manipulation command L corresponding to the amount of manipulation is generated. A brake releasing command is generated based on the manipulation command L, and the solenoid valve 50*b* is switched by the brake releasing command. Accordingly, the hydraulic oil of the pilot pump 15 is supplied to the cylinder 68 via the hydraulic line 27*b*. The force pressing against the brake plate 62 is reduced to zero due to the hydraulic pressure of the hydraulic oil, and thus, the brake is released.

A pressure sensor 52 (state monitoring unit) is provided in the hydraulic line 27*b*, and the hydraulic pressure in the cylinder 68 is monitored by the pressure sensor 52. The pressure information (hydraulic pressure) is sent to the inverter 20 serving as a determination unit.

The determination unit detects whether or not the braking performed by the mechanical brake 23 has been released using the pressure information.

When the determination unit detects that the braking performed by the mechanical brake 23 has been released, the determination unit performs the determination so that the inverter 20 serving as a control unit performs (performs a servo-on operation with respect to) the servo control of the swivel electric motor 21. Based on the determination, the control unit controls a motor current $i_m$ (control current) supplied to the swivel electric motor 21. The control unit controls the motor current $i_m$, and thus, the servo control of the swivel electric motor 21 is performed, and the servo control enters a servo-on state.

Moreover, when the determination unit detects that the braking performed by the mechanical brake 23 is actuated, the determination unit performs the determination so that the control unit does not perform (so that the control unit performs a servo-off operation with respect to) the servo control of the swivel electric motor 21. In this case, the servo control of the swivel electric motor 21 is not performed, and thus, the servo control enters a servo-off state.

The determination unit and the control unit may be the controller 30 or may be other controllers. That is, the determination unit and the control unit may be any one as long as a device having a function equivalent to that of the determination unit capable of determining an on-state and an off-state is provided in the control unit so that both the braking performed by the mechanical brake and the servo control of the swivel electric motor 21 do not enter the on-state or the off-state. The determination unit includes the CPU. Moreover, the control unit includes the calculation processing device including the CPU and the internal memory. The determination unit and the control unit may be separated from each other or may be integrated with each other.

According to the present embodiment, since deviation in the timing between the releasing of the braking performed by the mechanical brake 23 and the servo control of the swivel electric motor 21 does not occur, it is possible to effectively prevent the components of the mechanical brake from being worn.

Moreover, for example, when the shovel stops on a slope, it is possible to prevent the working element provided in the upper swivel body 3 from inevitably swiveling downward in the direction of the slope due to the weight of the upper swivel body 3.

Accordingly, it is possible to provide the shovel in which the deviation in the timing between the releasing of the braking performed by the mechanical brake 23 and the servo control of the swivel electric motor 21 is eliminated.

Figure 4:
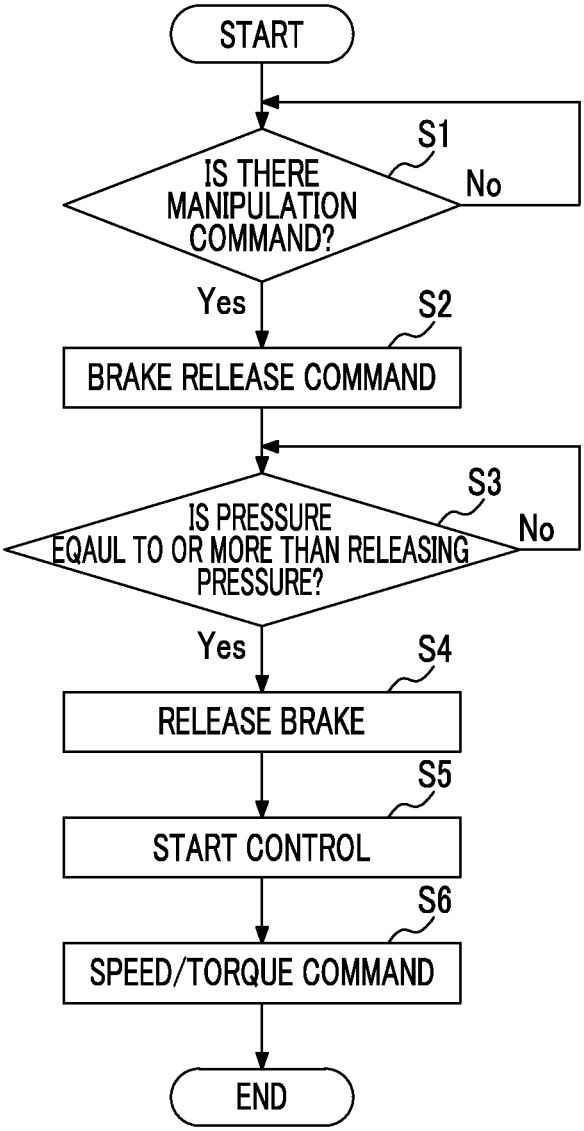
FIG. 4 is a flowchart explaining a control operation which releases braking performed by a brake device provided in the swivel driving device of FIG. 3.

Next, a control operation which releases the braking performed by the break mechanism 23 (mechanical brake) in the swivel driving device 40 mounted on the shovel according the embodiment will be described with reference to FIG. 4. FIG. 4 is a flowchart explaining the control operation which releases the braking performed by the brake device provided in the swivel driving device of FIG. 3.

First, the manipulation command L is not generated if the swivel lever is not manipulated (No in Step S1). In this case, the process does not proceed to the next step until the manipulation command L is generated. Meanwhile, the manipulation command L is generated if the swivel lever is manipulated (Yes in Step S1), and the process proceeds to Step S2. Specifically, the brake releasing command is sent to the solenoid valve 50*b* from the control unit . When the brake releasing command is sent to the solenoid valve 50*b*, the solenoid valve 50*b* is switched, and thus, the hydraulic oil is supplied to the mechanical brake 23 from the pilot pump 15. The pressure of the hydraulic oil is detected by the pressure sensor 52, and when the pressure is at a predetermined pressure (releasing pressure) or more (Yes in Step S3), the determination unit detects that the braking performed by the mechanical brake 23 has been released (the brake enters a braking-off state) (Step S4). Based on the detection, the determination unit determines the start of the servo control (determines a servo-on operation). Specifically, the control of the motor current $i_m$ supplied to the swivel electric motor 21 is started by the control unit. That is, the servo control of the swivel electric motor 21 starts (the servo control enters a servo-on state) (Step S5). More specifically, in the control unit, the speed command is generated based on the manipulation command L, and a torque command is generated by deviation between the speed command and the actual speed (Step S6). Moreover, the motor current $i_m$ corresponding to the command is supplied to the swivel electric motor 21, and the servo control is performed.

Meanwhile, when the determination unit does not detect that the pressure of the hydraulic oil is at the releasing pressure or greater (the pressure is less than the releasing pressure) (No in Step S3), the servo control of the swivel electric motor 21 is not performed until the pressure of the hydraulic oil is at the releasing pressure or greater. The process does not proceed to the next Step.

Figure 5:
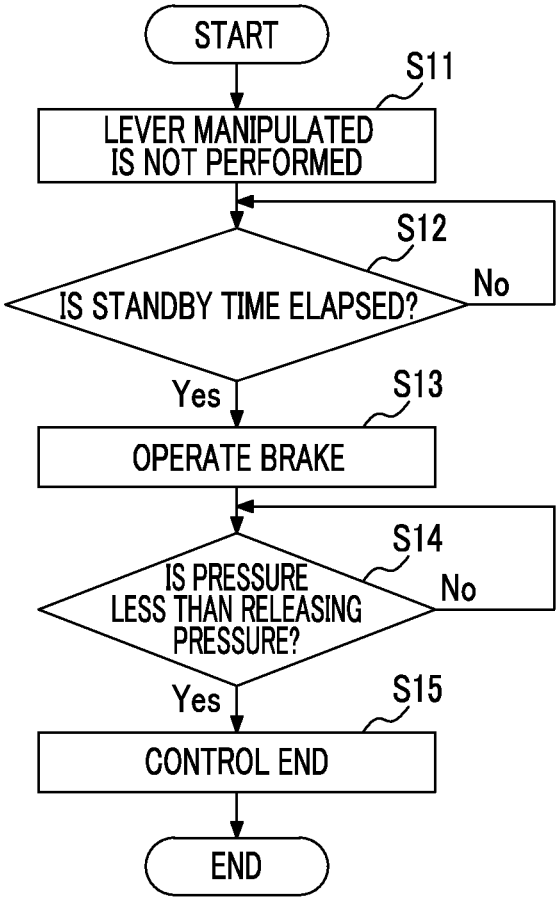
FIG. 5 is a flowchart explaining a control operation which actuates the braking performed by the brake device provided in the swivel driving device of FIG. 3.

Next, in the swivel driving device 40 mounted on the shovel according to the embodiment, the control operation which actuates the braking performed by the mechanical brake 23 will be described with reference to FIG. 5. FIG. 5 is a flowchart explaining the control operation which actuates the braking performed by the brake device provided in the swivel driving device of FIG. 3.

A case in which the operator returns the swivel lever to a neutral position and the braking performed by the mechanical brake 23 is switched from the releasing state to the operating state is considered.

First, in Step S11, when the swivel lever is not manipulated by the operator, it is waited until a predetermined standby time which is stored in the control unit in advance elapses (Step S12). When the predetermined amount of standby time elapses (Yes in Step S12), the brake releasing command is no longer sent to the solenoid valve 50*b*. Accordingly, the solenoid valve 50*b* is switched and the braking performed by the mechanical brake 23 is actuated (the brake enters the braking-on state) (Step S13). Even when the mechanical brake 23 is operated, the hydraulic pressure in the cylinder 68 is monitored by the pressure sensor 52. When the determination unit detects that the hydraulic pressure is less than the releasing pressure based on the pressure information (hydraulic pressure) obtained by the pressure sensor 52 (Yes in Step S14), the determination unit determines to end the servo control (a servo-off operation). In this case, the control unit does not generate the speed command and the torque command, and does not supply the motor current $i_m$ to the swivel electric motor 21. That is, the servo control of the swivel electric motor 21 ends (the servo control enters a servo-off state) (Step S15). When the standby time does not elapse (No in Step S12), the braking performed by the mechanical brake 23 does not occur, and the servo control of the swivel electric motor 21 is continued.

Moreover, when the determination unit does not detect that the pressure of the hydraulic oil is less than the releasing pressure (the pressure is at the releasing pressure or greater) (No in Step S13), the servo control of the swivel electric motor 21 is continued until the pressure of the hydraulic oil is less than the releasing pressure. The process does not proceed to the next Step.

In this way, when the servo control is transferred from the servo-on state to the servo-off state, the control unit actuates the braking performed by the mechanical brake 23. Here, according to the present embodiment, when the braking performed by the mechanical brake 23 does not occur, the servo control cannot enter the servo-off state. In order for both the braking performed by the mechanical brake 23 and the servo control of the swivel electric motor 21 not to be in the on-state, this is realized.

In the control operation which actuates the braking performed by the mechanical brake 23, unlike in the releasing control operation, a predetermined standby time is provided. Moreover, after the predetermined standby time elapses, the servo control of the swivel electric motor 21 ends (the servo control enters the servo-off state). According to the work contents, it is assumed that the swivel lever is operated again immediately after the braking performed by the mechanical brake 23 is released. In this case, when the swivel lever is manipulated, the solenoid valve 50*b* is switched, and thus, this is not preferable in terms of the control. Accordingly, in order to secure continuity of the control, in the control operation which actuates the braking performed by the mechanical brake 23, the elapse of the predetermined standby time is set as a condition thereof.

As described above, in the present embodiment, the servo-off determination is performed when the determination unit detects that the braking performed by the mechanical brake 23 is actuated, and the control unit does not generate the speed command and the torque command. The servo control of the swivel electric motor 21 is not performed. Moreover, when the determination unit detects that the braking performed by the mechanical brake 23 has been released, that is, when the determination unit detects that the brake is not operated, the determination of the servo-on is performed, the control unit generates the speed command and the torque command, and the servo control of the swivel electric motor 21 continues.

As a result, the driving of the upper swivel body 3 is controlled so that the braking performed by the mechanical brake 23 and the servo control of the swivel electric motor 21 are not simultaneously in the on-state or the off-state.

Specifically, during the braking performed by the mechanical brake 23 (during the braking-on state), the servo control of the swivel electric motor 21 does not start (the servo control does not enter the servo-on state). Accordingly, it is possible to effectively prevent the brake disk 60 or the brake plate 62 configuring the mechanical brake 23 from being worn.

Moreover, during the releasing of the braking performed by the mechanical brake 23 (during the braking-off state), the servo control of the swivel electric motor 21 does not end (the servo control does not enter the servo-off state). According to the present embodiment, it is possible to effectively prevent the braking performed by the mechanical brake 23 and the servo control of the swivel electric motor 21 from both being in the on-state or prevent the braking performed by the mechanical brake 23 and the servo control of the swivel electric motor 21 from both being in the off-state. Accordingly, it is possible to move the upper swivel body 3 to a safe and reliable control.

Then, a case in which the braking performed by the mechanical brake 23 is not actuated due to abnormality in the system of the control unit side or the like is assumed . For example, even when the operator does not manipulate the swivel lever, the brake releasing command may be generated. Accordingly, the hydraulic oil is supplied to the mechanical brake 23 from the pilot pump 15, and the solenoid valve 50*b* is switched.

In this case, when the hydraulic oil is supplied to the mechanical brake 23 and the detection value of the pressure sensor 52 is at the releasing pressure or greater, the determination unit detects that the braking performed by the mechanical brake 23 has been released. The control unit receives the detection and performs the confirmation of the servo-on state, and the servo control of the swivel electric motor 21 is performed. Accordingly, the braking performed by both the mechanical brake 23 and the servo control of the swivel electric motor 21 does not enter the off-state.

Moreover, in this way, when the braking performed by the mechanical brake 23 is released, even when the operator does not operate the swivel lever, a control which causes the rotational speed of the swivel electric motor 21 to be zero, a so-called zero speed control, is performed so that a stop state of the upper swivel body 3 is maintained. Specifically, a driving force (torque) which cancels an external force applied to the upper swivel body 3 is generated by driving the swivel electric motor 21. The control unit supplies the predetermined motor current $i_m$ to the swivel electric motor 21, and thus, the zero speed control is performed, and the stop state of the swivel electric motor 21 is maintained.

In this way, even when the braking performed by the mechanical brake 23 is not normal due to abnormality or the like in the control unit, since the servo control is performed so that the stop state of the swivel electric motor 21 is maintained, safety of the upper swivel body 3 is secured.

In addition, for example, even when a lever other than the swivel lever, that is, a travelling lever is manipulated, the manipulation command L is generated. Accordingly, during the travelling of the shovel, the braking performed by the mechanical brake 23 is released. Accordingly, when the shovel travels, the above-described zero speed control is performed so that the stop state of the upper swivel body 3 is maintained by the swivel electric motor 21. Since the braking performed by the mechanical brake 23 is released, even when any external force is applied during the travelling of the shovel, the brake disk 60 or the brake plate 62 configuring the mechanical brake 23 is not worn. Moreover, during the travelling of the shovel, the stop state of the upper swivel body 3 is maintained.

In addition, a case in which foreign substances enter the solenoid valve 50*b*, a spool is stuck, and the switching of the solenoid valve is not performed, or a case in which the pipe 27*b* is clogged by the foreign substances and the supply of the hydraulic oil to the mechanical brake 23 is interrupted is assumed. In this case, even when the swivel lever is manipulated, the braking performed by the mechanical brake 23 is not released. Moreover, in this case, the determination unit performs the determination of the servo-off state, and thus, the control unit does not supply the motor current $i_m$ to the swivel electric motor 21. That is, the swivel electric motor 21 does not perform the servo control.

Accordingly, it is possible to effectively prevent the brake disk 60 or the brake plate 62 configuring the mechanical brake 23 from being worn.

Figure 6:
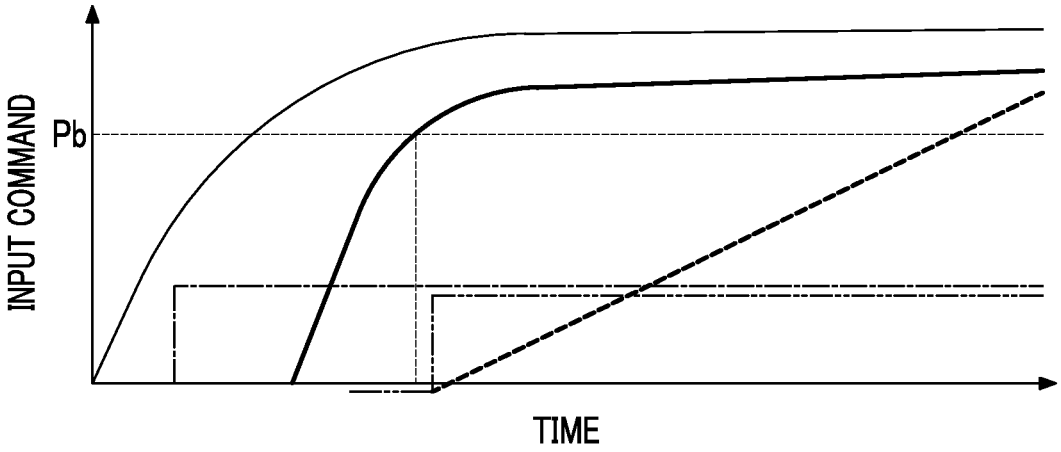
FIG. 6 is a view showing waveforms occurring during control timing of the swivel driving device of FIG. 3.

Next, control timing by the control of the upper swivel body 3 according to the present embodiment will be described with reference to FIG. 6. FIG. 6 is a view showing waveforms occurring during the control timing of the swivel driving device of FIG. 3. The horizontal axis indicates time. The vertical axis indicates various inputs and commands. Moreover, a thick line indicates brake releasing pressure, a thin line indicates the amount of input of the swivel lever, a broken line indicates the speed command, a one-dot chain line indicates the brake releasing command, and a two-dot chain line indicates the control start command, respectively.

As shown in FIG. 6, when the swivel lever is manipulated and the amount of input of the swivel lever reaches a predetermined input value (thin line), the brake releasing command (one-dot chain line) is generated. Accordingly, the hydraulic oil from the pilot pump 15 is supplied to the mechanical brake 23 via the solenoid valve 50*b*, and the brake releasing pressure (thick line) is increased. When the brake releasing pressure reaches a predetermined releasing pressure Pb, the servo control of the swivel electric motor 21 is performed (the servo control enters the servo-on state). That is, in the control unit, the control start command (two-dot chain line) is generated. Specifically, based on the speed command (broken line) and the torque command generated in the control unit, the motor current $i_m$ for driving the swivel electric motor 21 is supplied to the swivel electric motor 21, and the servo control starts.

In this way, since the amount of input of the swivel lever and various commands are generated, deviation in the timing between the releasing of the braking performed by the mechanical brake 23 and the servo control of the swivel electric motor 21 does not occur. Accordingly, it is possible to effectively prevent the components of the mechanical brake from being worn.

Moreover, for example, when the shovel stops on a slope, it is possible to prevent the working element provided in the upper swivel body 3 from inevitably swiveling downward in the direction of the slope due to the weight of the upper swivel body 3.

Accordingly, it is possible to provide the shovel in which the deviation in the timing between the releasing of the braking performed by the mechanical brake 23 and the servo control of the swivel electric motor 21 is eliminated.

Moreover, since the servo control of the swivel electric motor 21 is not performed in an unnecessary manner, it is possible to decrease energy consumption of the swivel electric motor 21.

Moreover, according to the present embodiment, since the control state of the swivel electric motor 21 is switched at the releasing pressure of the brake, it is possible to provide the shovel including the swivel driving device which can be applied even under circumstances in which characteristics of the hydraulic oil change remarkably, such as those in a cold region.

Figure 7A:
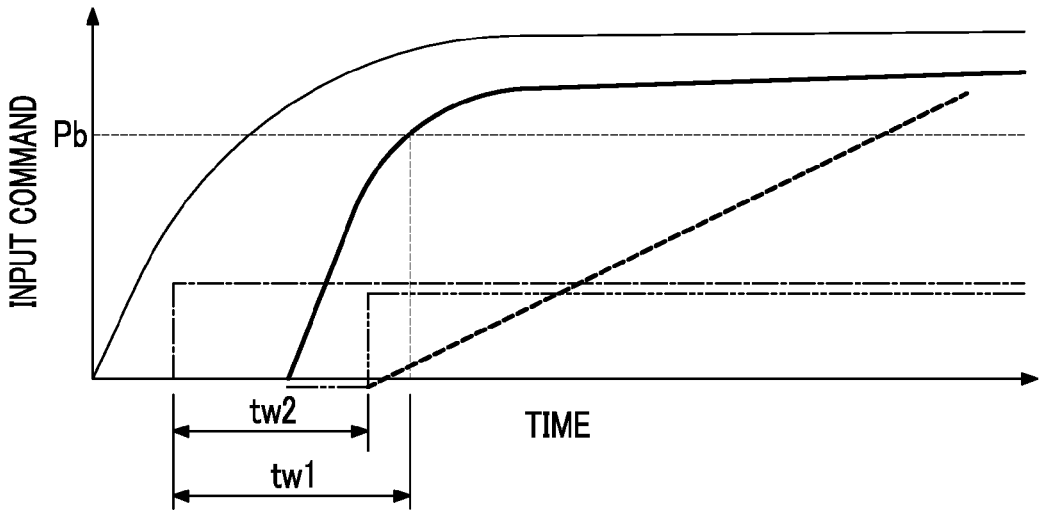
FIG. 7A is a view showing waveforms occurring during the control timing of a swivel driving device according to an embodiment different from the embodiment of FIG. 3, and shows waveforms occurring in a case in which the timing when the brake is released is later than a standby time.
Figure 7B:
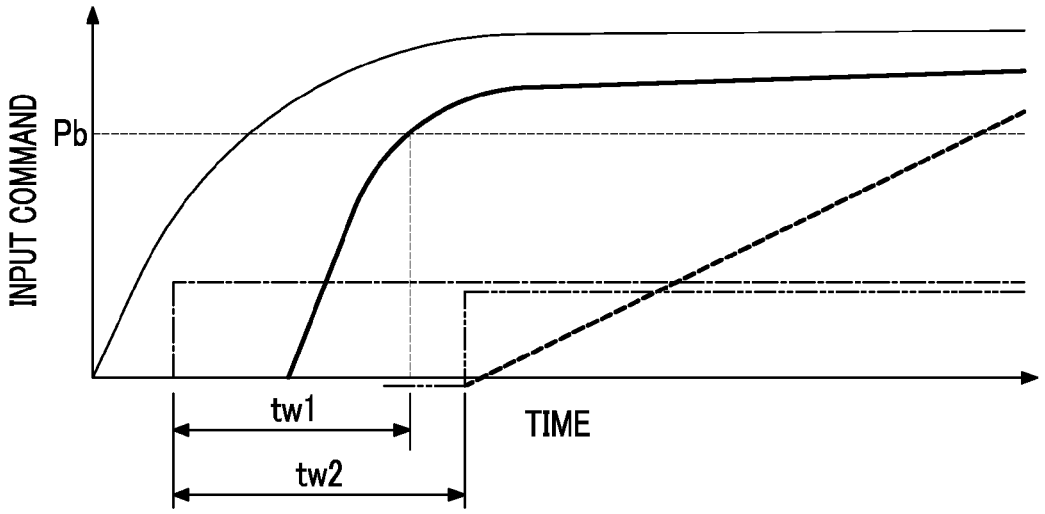
FIG. 7B is a view showing waveforms occurring during the control timing of a swivel driving device according to the embodiment different from the embodiment of FIG. 3, and shows waveforms occurring in a case in which the timing when the brake is released is earlier than a standby time.

Next, the control timing when the control of the upper swivel body 3 according to the present embodiment is not performed will be described with reference to FIGS. 7A and 7B. FIGS. 7A and 7B are views showing waveforms occurring during the control timing of the swivel driving device according to an embodiment different from that in the FIG. 3. The horizontal axis indicates time, and the vertical axis indicates various inputs and commands. In addition, a thick line indicates the brake releasing pressure, a thin line indicates the amount of input of the swivel lever, a broken line indicates the speed command, a one-dot chain line indicates the brake releasing command, and a two-dot chain line indicates the control start command, respectively.

Unlike the control of the upper swivel body 3 according to the present embodiment, the releasing of the brake is switched according to time. Specifically, the timing when the brake is released is performed after the proper amount of time elapses, and it is transferred to the driving control of the swivel electric motor 21 after the predetermined standby time elapses.

The operating and releasing of the brake are performed by the switching of the amount of hydraulic pressure supplied to the mechanical brake 23. Accordingly, deviation between timing (tw1) when the brake is actually released and the timing (standby time) (tw2) of the control of the swivel electric motor 21 occurs. According to FIG. 7A, the timing (tw1) when the brake is actually released is later than the standby time (tw2). Moreover, according to FIG. 7B, and the timing (tw1) when the brake is actually released is earlier than the standby time (tw2).

According to the present embodiment, since the deviation between the timing of the releasing of the brake and the timing of the driving of the swivel electric motor 21 does not occur and synchronization therebetween is attained, unlike those shown in FIG. 7A, the timing (tw1) when the brake is released is not late. The brake disk 60 or the brake plate 62 configuring the mechanical brake 23 is not worn, and life of the mechanical brake 23 is improved.

Moreover, according to the present embodiment, unlike those shown in FIG. 7B, the timing (tw1) when the brake is released is not early. Accordingly, even when the braking performed by the mechanical brake 23 is in the on-state, the servo control of the swivel electric motor 21 enters a state other than the on-state, that is, the braking performed by both the mechanical brake 23 and the servo control of the swivel electric motor 21 do not enter the off-state. Accordingly, the upper swivel body 3 is not swiveled according to the intention of the operator. For example, when the shovel is positioned on a slope, it is possible to prevent the working element provided in the upper swivel body 3 from inevitably swiveling downward in the direction of the slope due to the weight of the upper swivel body 3.

Hereinbefore, the embodiment of the swivel driving device provided in the construction machine such as the shovel is described. However, certain embodiments of the invention are not limited to the above-described embodiments. Various modifications and improvements such as combinations or replacement of a portion or the entirety of other embodiments may be included within the scope of certain embodiments of the invention.

Figure 8:
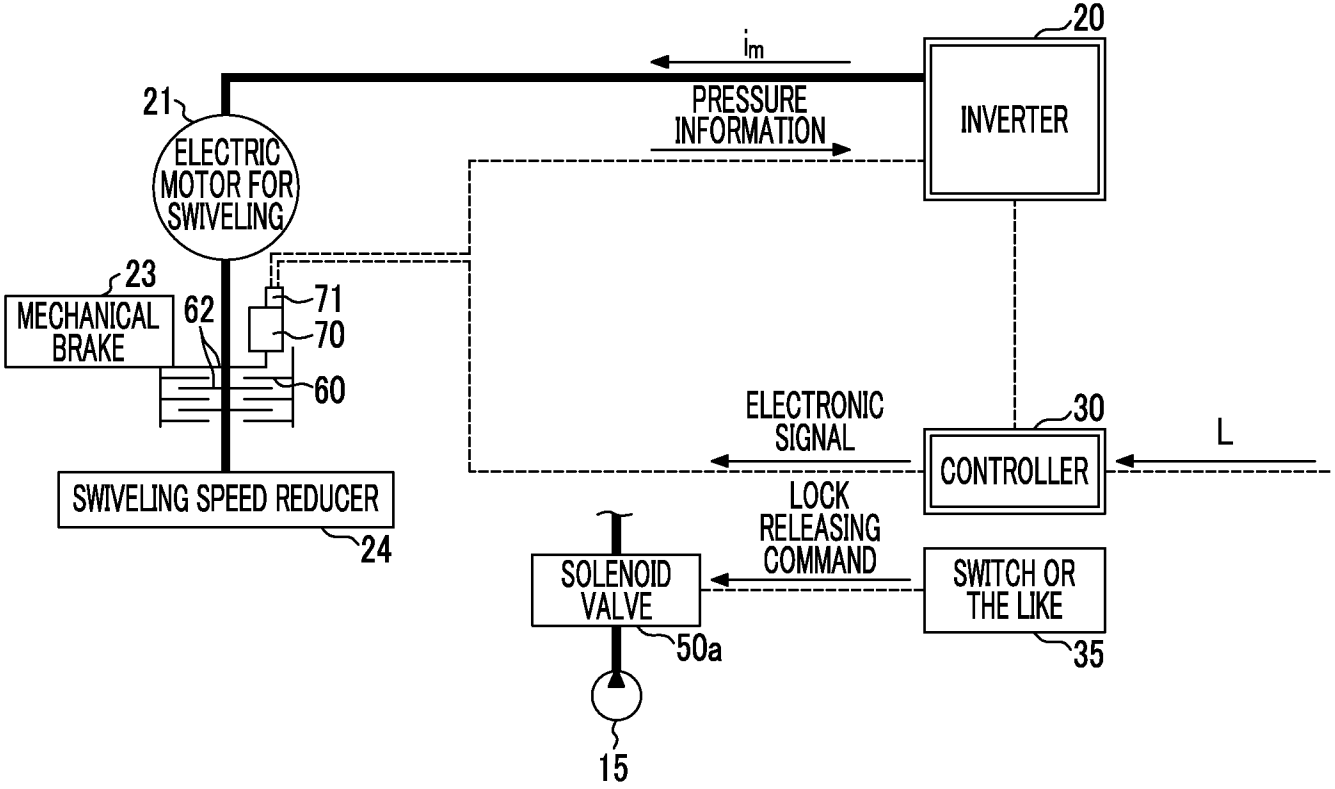
FIG. 8 is a block diagram showing a control mechanism of a swivel driving device provided in a shovel according to still another embodiment.

In the present embodiments, as the brake mechanism, the mechanical brake 23 in which the releasing or the operating of the brake is switched due to a change in the hydraulic pressure is described. However, certain embodiments of the invention are not limited to this. For example, as shown in FIG. 8, the brake mechanism may include a configuration in which the upper brake plate 62 is pressed against the brake disk 60 while a solenoid 70 is electrically switched. In this case, whether or not the brake is released may be determined by a position sensor 71 which detects the switching position of the solenoid 70 or the displacement of the brake plate 62. Alternatively, whether or not the brake is released may be determined by a force sensor which detects the pressing force of the solenoid 70. Moreover, the determination unit is not limited to the sensors, and any kind of sensor may be adopted as long as it can detect the braking force (holding force) of the brake.

Moreover, the swivel driving device of the present embodiments can be widely used in the construction machine which swivels and drives the upper swivel body 3 with the swivel driving device. For example, the swivel driving device can be widely used in a shovel, a forestry machine, a crane, a construction machine of a lifting magnet specification, or the like.

It should be understood that the invention is not limited to the above-described embodiment, but may be modified into various forms on the basis of the spirit of the invention. Additionally, the modifications are included in the scope of the invention.

What is claimed is:

1. An electric swiveling type construction machine comprising:

a lower travelling body;

an upper swivel body which is turnably mounted on the lower travelling body;

a boom in which one end is rotatably attached to the upper swivel body;

an arm in which one end is rotatably attached to the other end of the boom;

a working element which is rotatably attached to the other end of the arm;

a brake mechanism which includes a brake unit and a brake operating mechanism which allows the brake unit to enter the releasing state of the brake or a hold state, and holds the upper swivel body;

a swiveling electric motor which swivels and drives the upper swivel body;

a state monitoring unit which monitors a state of the brake mechanism;

a determination unit which detects a releasing state of a brake performed by the brake mechanism based on the monitoring performed by the state monitoring unit;

a controller which generates a speed command based on an amount of manipulation of a swiveling lever;

an inverter which supplies power to the swiveling electric motor based on the speed command, and performs a servo control of the swiveling electric motor;

a hydraulic source; and a hydraulic line which connects the brake operating mechanism and the hydraulic source, wherein the swiveling electric motor is transferred to a servo control state when the determination unit detects the releasing of the brake, the inverter starts the servo control of the swiveling electric motor when the determination unit detects the releasing state of the brake, the state monitoring unit monitors a state of the brake operating mechanism, the state monitoring unit is a pressure sensor which detects a pressure of the hydraulic line connected to the brake operating mechanism, and the determination unit detects whether or not the brake unit is in the releasing state of the brake based on a pressure detection value of the press sensor and the swiveling electric motor is transferred to the servo control state when the brake unit is in the releasing state of the brake.

2. An electric swiveling type construction machine comprising:

a lower travelling body;

an upper swivel body which is turnably mounted on the lower travelling body;

a boom in which one end is rotatably attached to the upper swivel body;

an arm in which one end is rotatably attached to the other end of the boom;

a working element which is rotatably attached to the other end of the arm;

a brake mechanism which includes a brake unit and a brake operating mechanism which allows the brake unit to enter the releasing state of the brake or a hold state, and holds the upper swivel body;

a swiveling electric motor which swivels and drives the upper swivel body;

a state monitoring unit which monitors a state of the brake mechanism;

a determination unit which detects a releasing state of a brake performed by the brake mechanism based on the monitoring performed by the state monitoring unit a controller which generates a speed command based on an amount of manipulation of a swiveling lever;

an inverter which supplies power to the swiveling electric motor based on the speed command, and performs a servo control of the swiveling electric motor;

hydraulic source;

a hydraulic line which connects the brake operating mechanism and the hydraulic source;

a manipulation lever for manipulating an actuator;

a switching valve provided in the hydraulic line; and a lever manipulation determination unit which is included in the controller and determines whether or not there is lever manipulation for a predetermined time, wherein the swiveling electric motor is transferred to a servo control state when the determination unit detects the releasing of the brake, the inverter starts the servo control of the swiveling electric motor when the determination unit detects the releasing state of the brake, the state monitoring unit monitors a state of the brake operating mechanism, the state monitoring unit is a pressure sensor which detects a pressure of the hydraulic line connected to the brake operating mechanism, when the brake unit is in the servo control state and there is no lever manipulation for a predetermined time, the brake unit is transferred to the hold state by performing switching control of the switching valve, and the servo control is released when the value of the pressure sensor reaches a releasing pressure after performing the switching control of the switching valve.

* * * * *